US005679054A

United States Patent [19]

Chun et al.

[11] Patent Number: 5,679,054

[45] Date of Patent: Oct. 21, 1997

[54] APPARATUS FOR GRINDING THE SCREEN PANEL OF A CATHODE RAY TUBE

[75] Inventors: Hong-Seok Chun, Seoul; Yong-Tae Song; Hoon-Joon Yoo, both of Kyunggi-do, all of Rep. of Korea

[73] Assignee: Samsung Display Devices Co., Ltd., Kyunggi-do, Rep. of Korea

[21] Appl. No.: 514,270

[22] Filed: Aug. 11, 1995

[30] Foreign Application Priority Data

Dec. 7, 1994 [KR] Rep. of Korea ..... 94-33173

[51] Int. Cl.[6] ..... B24B 49/00

[52] U.S. Cl. ..... 451/9; 451/10; 451/11; 451/24; 451/213; 451/216

[58] Field of Search ..... 451/9, 10, 11, 451/12, 24, 736, 137, 138, 212, 213, 216, 226, 392, 393, 395, 396

[56] References Cited

U.S. PATENT DOCUMENTS

| | | | |
|---|---|---|---|
| 2,569,005 | 9/1951 | Kindling | 451/216 |
| 2,994,990 | 8/1961 | Wrobbel | 451/213 |
| 3,046,702 | 7/1962 | Bretscher | 451/213 |
| 3,902,282 | 9/1975 | Roscoe et al. | 451/396 |
| 4,907,371 | 3/1990 | Shada et al. | 451/9 |
| 5,152,707 | 10/1992 | Dougherty et al. . | |

*Primary Examiner*—Eileen P. Morgan
*Attorney, Agent, or Firm*—Christie, Parker & Hale, LLP

[57] ABSTRACT

Disclosed is an apparatus for grinding the screen panel of a CRT. A jig pallet for holding the screen panel of a CRT is fixedly supported by a jig pallet support plate by means of a pivoting mechanism. The screen panel is fixedly mounted in the jig pallet by means of a plurality of fixing cylinders. A wheel-type grind felt device for grinding the surface of the screen panel is provided over the jig pallet. The rotational axis of the wheel-type grind felt device is parallel with the pivoting axis of the jig pallet. The wheel-type grind felt device contacts and grinds the portions of the surface of the screen panel in stepwise manner while the screen panel is pivoting about a pivot pin. A cooling fluid supply tube is provided for supplying a cooling liquid between the surface of the screen panel and the peripheral surface of the wheel-type grind felt device. The wheel-type grind felt device consists of a pair of rubber disks mounted on the shaft of a driven pulley with a space between them and a ring-shaped felt for covering the space.

20 Claims, 6 Drawing Sheets

APPARATUS FOR GRINDING THE SCREEN PANEL OF A CATHODE RAY TUBE

FIELD OF THE INVENTION

The present invention concerns an apparatus for grinding the screen panel of a cathode ray tube (CRT).

DESCRIPTION OF THE CONVENTIONAL ART

FIG. 8 schematically illustrates a pair of abrading felt 106 respectively mounted at both ends of the shaft 104 of a motor 102 to grind the surface of the screen panel of a cathode ray tube. Such a conventional device is manually operated to grind the surface of the screen panel which has surface defects or defective coating. When performing the grinding operation, the dust generated from the grinding is scattered flown in the atmosphere surrounding the operators, thus affecting their health undesirably. In addition, it is hardly possible for even the skilled workers to uniformly grind the surface of the screen panels, so that the finished panel has portions of irregular curvatures causing the distortion of the images displayed on the screen. Furthermore, when a number of the screen panels are found having defective surfaces, there are required a great number of operators to regrind the defective surfaces within a short time.

SUMMARY OF THE INVENTION

It is an object of the present invention to provide an apparatus for grinding the screen panel of a CRT of any size with means for preventing the dust generated from the grinding from being flown in the atmosphere surrounding the operators.

It is another object of the present invention to provide means for uniformly grinding the surface of the screen panel of a CRT so that the distortion of the images displayed on the screen panel is eliminated.

It is still another object of the present invention to provide an apparatus for grinding the screen panel of a CRT which may also deal with a faulty coating of charge-preventive and colour-enhancement.

To achieve the above objects, the present invention provides an apparatus for grinding the screen panel of a CRT comprising a jig pallet for holding the screen panel, a pivoting means for pivoting the jig pallet upwardly and downwardly, a jig pallet support plate for fixedly supporting the jig pallet by means of the pivoting means, a conveyor means for rectilinearly moving the jig pallet support plate in a direction toward a discharge station, a wheel-type felt means for grinding the surface of the screen panel, a felt drive means for rotating the wheel-type felt means, a support and moving structure for supporting the wheel-type felt means and the felt drive means and moving them horizontally in the direction of the pivoting axis of the jig pallet and vertically, a first sensor for detecting the first vertical position of the support and moving structure indicating inoperative position, a second sensor for detecting the second vertical position of the support and moving structure indicating operative position, a plurality of third sensors for detecting the horizontal position of the support and moving structure, and a cooling means for supplying a cooling fluid between the surface of the screen panel and the peripheral surface of the wheel-type felt means, wherein the surface of the screen panel is contacted and ground by the peripheral surface of the wheel-type felt means when the support and moving structure is positioned in the second vertical position.

The pivoting means is designed to upwardly and downwardly pivot the jig pallet about its central axis which is parallel with the rotational axis of the wheel-type felt means, so that if the wheel-type felt means rotates with contacting the surface of the screen panel for a given time step by step through moving multiple working positions detected by the third sensors, the whole surface of the screen panel is uniformly ground without substantial discontinuity.

The present invention will now be described more specifically with reference to the drawings attached only by way of example.

DETAILED DESCRIPTION OF PREFERRED EMBODIMENTS

Figure 1:
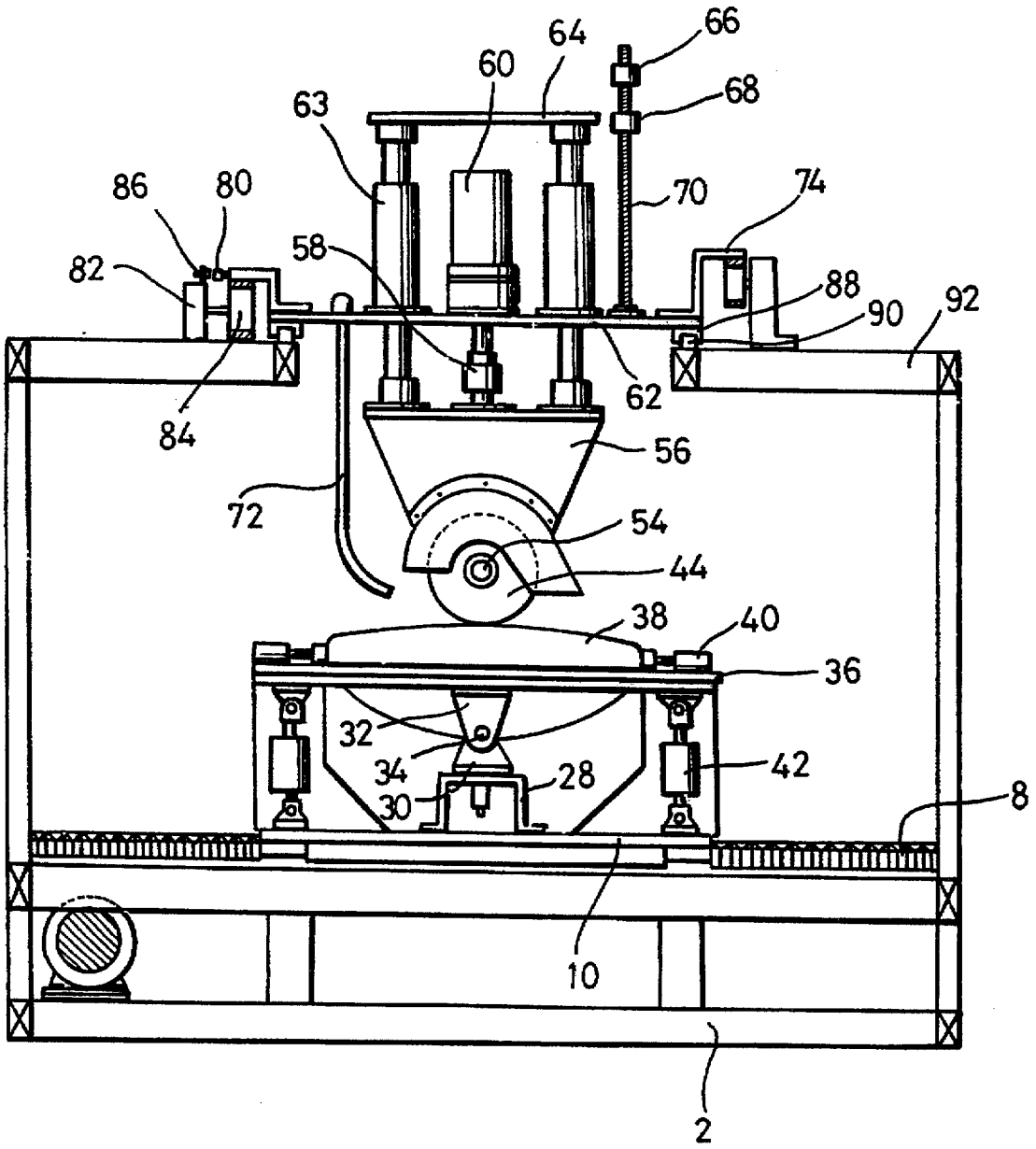
FIG. 1 is a schematic front elevational view of an apparatus for grinding the screen panel of a CRT according to an embodiment of the present invention.
Figure 2:
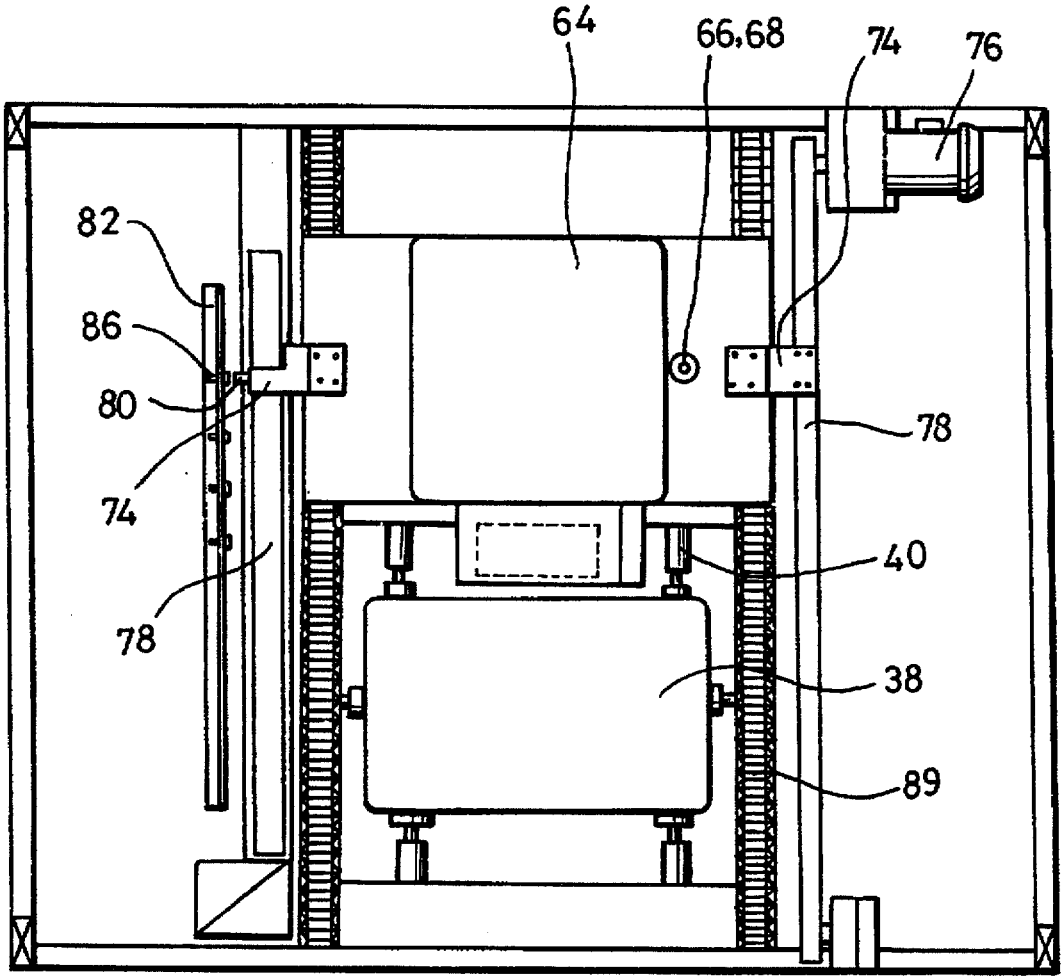
FIG. 2 is a plane view of the apparatus of FIG. 1.
Figure 3:
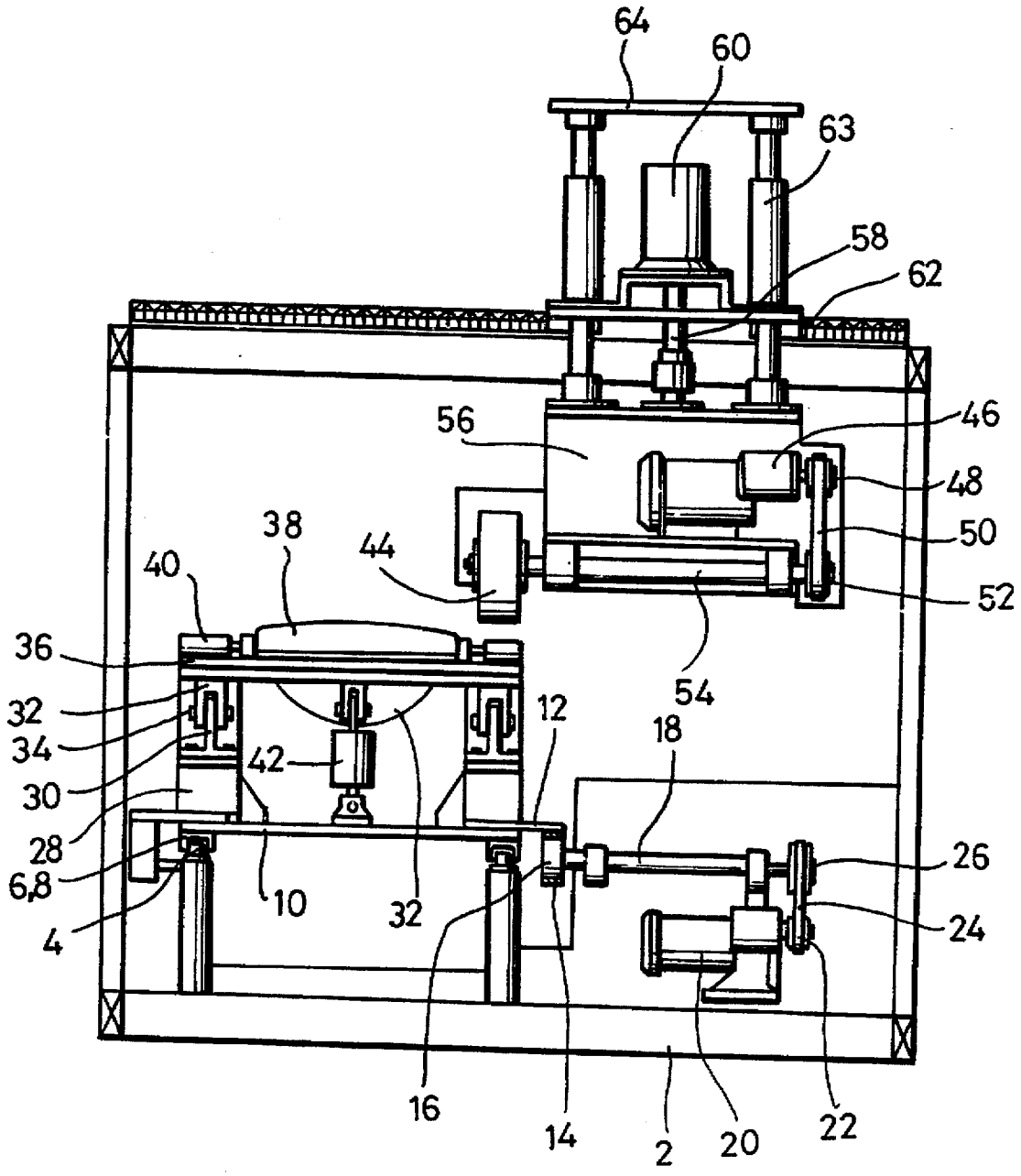
FIG. 3 is a side elevational view of the apparatus of FIG. 1.

Specifically shown in FIGS. 1, 2 and 3 is an apparatus for grinding the screen panel of a CRT according to an embodiment of the present invention. A jig pallet 36 for holding the screen panel 38 of a CRT is fixedly supported by a jig pallet support plate 10 by means of a pivoting mechanism. The screen panel 38 is fixedly mounted in the jig pallet 36 by means of a plurality of fixing cylinders 40.

The pivoting mechanism includes a pair of pivot pin assemblies respectively mounted beneath two side ends of the jig pallet 36 and a pair of cylinders 42 respectively mounted beneath the other two side ends thereof. The pivot pin assemblies includes a pair of upper hold blocks 32 respectively fixed beneath the two side ends, a pair of lower support blocks 30 corresponding to the upper hold blocks, a pair of base part 28 fixedly mounted on the jig pallet support plate 10 for respectively supporting the lower support blocks 30, and a pair of pivot pins 34 for each pivotally connecting one of the upper hold blocks 32 with one of the lower support blocks 30. The pivot pin assemblies are mounted beneath the centre of the two side ends of the jig pallet 36, so that the jig pallet 36 may be pivoted about the pivot pins 34 by working of the two cylinders 42.

A pair of slide channels 6 are respectively attached beneath the jig pallet support plate 10 at the two side corresponding to the positions of the pivot pin assemblies. The slide channels 6 are slidably mounted on the corresponding guide rails 4 that are in turn mounted on a bottom plate 2 of a mounting frame. There is provided a conveyor belt 14 which is driven by a motor 20 through a drive pulley 22 attached to the shaft of the motor 20. The drive pulley 22 is operatively connected with a driven pulley 26 by means of a belt 24. The driven pulley 26 is attached to a shaft 18 with a conveyor pulley 16, which consequently drives the conveyor belt 14. A connector 12 is attached to one side of the jig pallet support plate 10 adjacent to one of the base parts 28 so as to operatively connect the jig pallet support plate 10 with the conveyor belt 14. The conveyor belt 14 is to rectilinearly move the jig pallet support plate 10 in a direction toward a discharge station.

A wheel-type grind felt device 44 for grinding the surface of the screen panel 38 is provided over the jig pallet 36. The wheel-type grind felt device 44 is attached to a shaft 54 of a driven pulley 52 connected with a drive pulley 48 of a motor 46 by means of a belt 50. The drive mechanism for driving the wheel-type grind felt device 44 is integrally mounted in a grinder support 56, which is in turn attached to a carriage plate 62 by means of a drive cylinder 60 with a piston rod 58. The drive cylinder 60 is fixed on the carriage plate 62. The grinder support 56 is connected to the outer end of the piston rod 58. A pair of auxiliary cylinders 63 are respectively mounted at both sides of the drive cylinder 60 on the carriage plate 62. A fixing plate 64 is fixed on the upper ends of the piston rods of the auxiliary cylinders 63 over the drive cylinder 60. A screw rod 70 with first and second sensors 66 and 68 is provided on one side of the drive cylinder 60. These sensors may be any conventional sensors known in the art, by way of example, optical sensors. On the other side of the drive cylinder 60 is provided a cooling fluid supply tube 72 for supplying a cooling liquid between the surface of the screen panel 38 and the peripheral surface of the wheel-type grind felt device 44.

Figure 4:
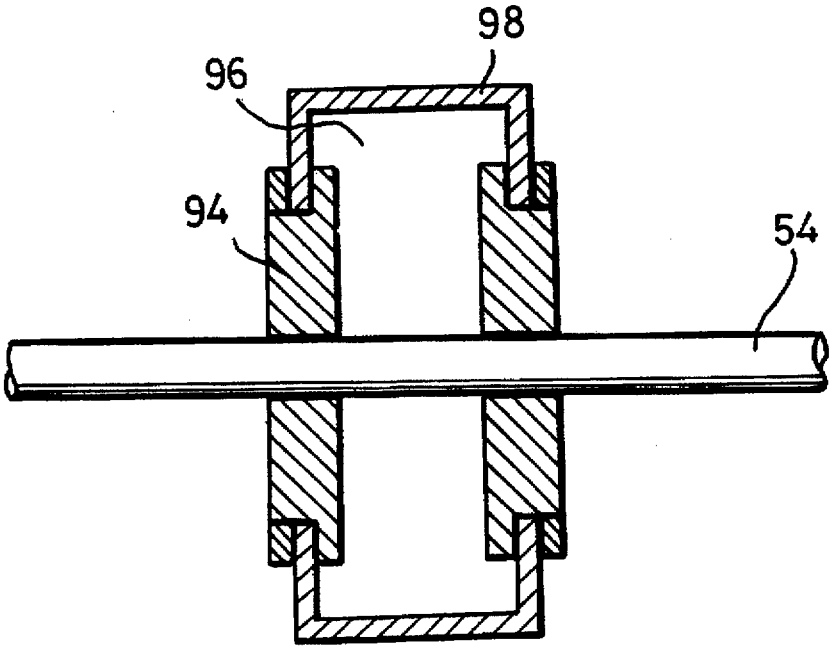
FIG. 4 schematically illustrates a felt grind wheel with an inner air space according to another embodiment of the present invention.
Figure 8:
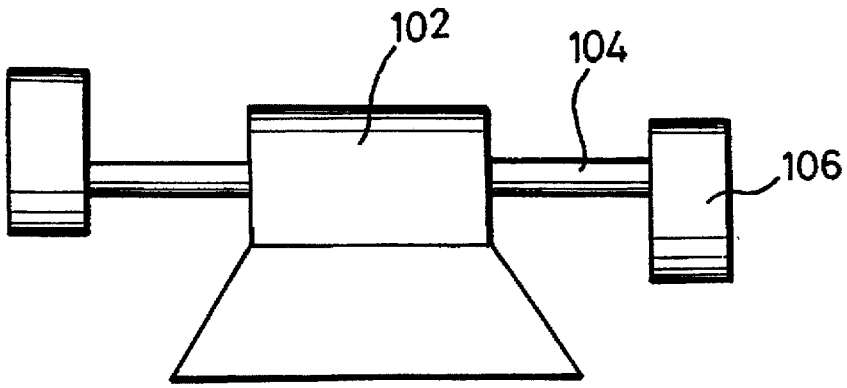
FIG. 8 schematically illustrates a pair of conventional abrading felt respectively mounted at both ends of a shaft of a motor.

The wheel-type grind felt device 44 is designed to have its rotational axis parallel with the pivoting axis of the jig pallet 36. A pair of brackets 74 are respectively attached to two side ends connected to a conveyor belt 78 driven by a motor 76. One of the brackets 74 has a projection 80 that serves as a reference point sensed by a plurality of third sensors 86 mounted in a support strip 82 attached to an upper plate 92 of the frame. These sensors may also be any conventional sensors known in the art, by way of example, optical sensors. A pair of slide channels 88 are respectively attached beneath side ends of the carriage plate 62. The slide channels 88 are guided by a pair of guide rails 90 mounted on the upper plate 92. Referring to FIG. 4, the wheel-type grind felt device 44 consists of a pair of rubber disks 94 mounted on the shaft 54 of the driven pulley 52 with a space 96 between them and a ring-shaped felt 98 for covering the space 96. The ring-shaped felt 98 contacts and grinds the surface of the screen panel 38. Additionally, the guide rails 4 and 90 are provided with bellows 8 and 88.

In operation, the screen panel 38 is fixed on the jig pallet 36 by means of the fixing cylinders 40. The wheel-type grind felt device 44 is rotated by the motor 46 and moved onto the screen panel 38 by operating the drive cylinder 60, of which the piston rod 58 pushes the grind support 56. The vertical position of the grind support 56 is controlled by the fixing plate 64, one end of which is detected by the first and second sensors 66 and 68. The first sensor 66 indicates the inoperative position of the wheel-type grind felt device 44 and the second sensor 68 does the operative position. Meanwhile, the cylinders 42 is operated so as to pivot the jig pallet 36 on the pivot pins 34. Then, the wheel-type grind felt device 44 contacts and grinds a first portion of the surface of the screen panel 38 while the screen panel 38 is pivoting about the pivot pin 34 by working the cylinders 42.

Figure 5:
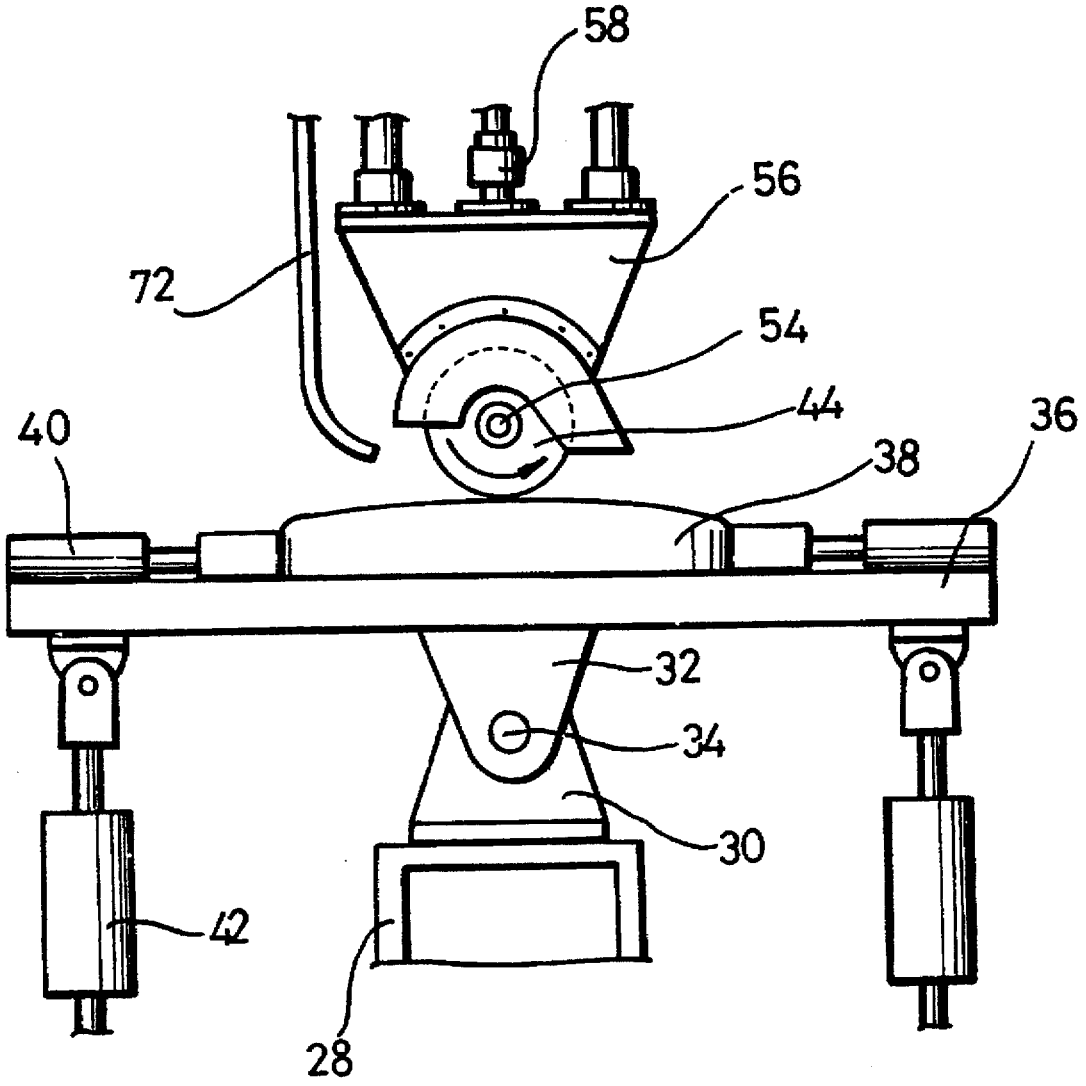
FIG. 5 illustrate the specific grinding phases of the inventive apparatus.
Figure 6:
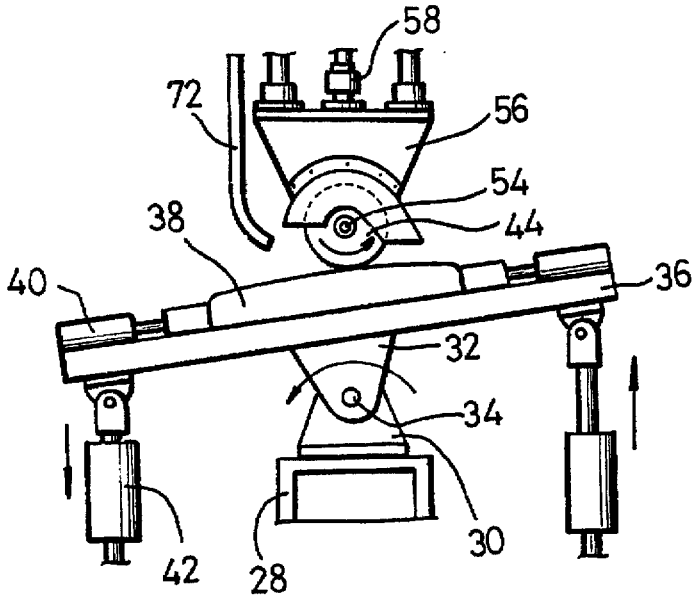
FIG. 6 illustrate the specific grinding phases of the inventive apparatus.
Figure 7:
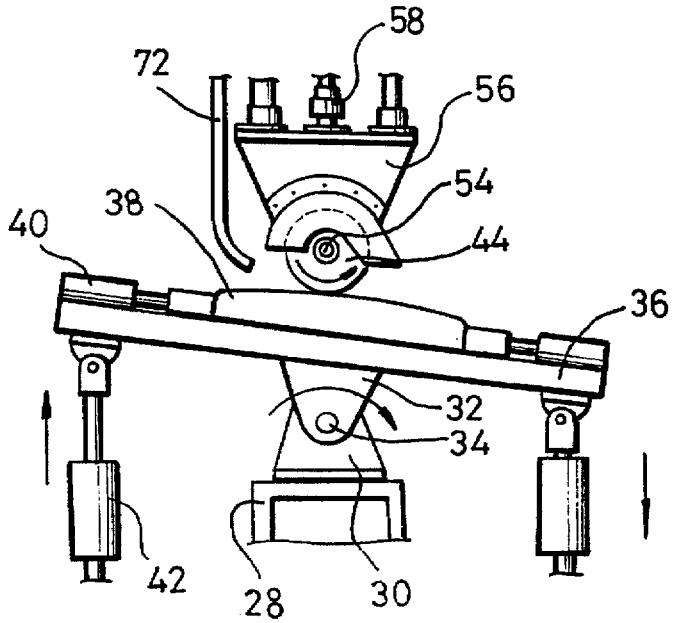
FIG. 7 illustrate the specific grinding phases of the inventive apparatus.

Namely, as shown in FIGS. 5, 6 and 7, the piston rods of the cylinders 42 alternately push and pull the corresponding edges of the jig pallet 36 while the grinding is performed. At this time, the tube 72 supplies cooling liquid between the surface of the screen panel 38 and the peripheral surface of the grind felt device 44 so as to cool the grinding surfaces and to collect the dust rubbed out from the ground surface as soaked in the cooling liquid. After the grinding of the first portion is completed, the grind felt device 44 is moved toward a second portion of the surface of the screen panel 38 by moving the conveyor belt 78 and thus the carriage plate 62 along the guide rails. When the projection 80 of the bracket 74 is detected by the third sensor 86 indicating the second portion, the motor 76 is turned off to stop the moving of the carriage plate 62. Then the second portion of the screen panel 38 is positioned beneath the grind felt device 44 and ground while pivoting the jig pallet 36. Likewise, the remaining portions of the screen panel 38 are sequentially ground.

When the whole surface of the screen panel 38 is finished ground, the motor 20 mounted on the bottom plate 2 is turned on to move the conveyor belt 14 so as to convey the jig pallet support plate 10 toward the discharge station, where the screen panel is unloaded from the jig pallet 36.

What is claimed is:

1. An apparatus for grinding a screen panel of a cathode ray tube (CRT) comprising:

a jig pallet for holding said screen panel;

pivoting means for pivoting said jig pallet;

jig pallet support plate for fixedly supporting said jig pallet by means of said pivoting means;

conveyor means for rectilinearly moving said jig pallet support plate in a direction toward a discharge station;

a wheel-shaped felt device rotating about an axis for grinding the surface of said screen panel;

drive means for rotating said wheel-shaped felt device;

a support and moving structure for supporting said wheel-shaped felt device and said drive means and moving them horizontally and vertically;

a first sensor for detecting a first vertical position of said support and moving structure indicating inoperative position;

a second sensor for detecting a second vertical position of said support and moving structure indicating operative position;

a plurality of third sensors for detecting the horizontal position of said support and moving structure; and cooling means for supplying a cooling fluid between the surface of said screen panel and the peripheral surface of said wheel-shaped felt device, the surface of said screen panel being contacted and ground by the peripheral surface of said wheel-shaped felt device when said supporting and moving structure is positioned in said second vertical position.

2. The apparatus as defined in claim 1, wherein said pivoting means includes a pair of pivot pin assemblies respectively mounted beneath two opposite sides of said jig pallet and a pair of cylinders respectively mounted beneath another two opposite sides thereof for alternatively pushing and pulling each of said another two opposite sides, so that said jig pallet pivots about an axis parallel with the rotational axis of said wheel-shaped felt device.

3. The apparatus as defined in claim 2, wherein each of said pivot pin assemblies comprises a pair of upper hold blocks respectively fixed beneath said two side ends, a pair of lower support blocks corresponding to said upper hold blocks, a pair of base part fixedly mounted on said jig pallet support plate for respectively supporting said lower support blocks, and a pair of pivot pins for each pivotally connecting one of said upper hold blocks with one of said lower support blocks.

4. The apparatus as defined in claim 3, wherein said wheel-shaped felt device comprises a wheel-shaped grind felt device for grinding the surface of said screen panel, and a shaft of a driven pulley for mounting said wheel-shaped grind felt device, said driven pulley being connected with a drive pulley of a motor by means of a belt, the rotational axis of said wheel-shaped grind felt device being parallel with the pivoting axis of said jig pallet.

5. The apparatus as defined in claim 4, wherein said wheel-shaped grind felt device comprises a pair of rubber disks mounted on the shaft of said driven pulley with a space between them and a ring-shaped felt for covering said space.

6. The apparatus as defined in claim 4, wherein said support and moving structure comprises a grinder support attached to a carriage plate by means of a drive cylinder with a piston rod, said drive cylinder being fixed on said carriage plate, a pair of auxiliary cylinders mounted at both sides of said drive cylinder on said carriage plate, a fixing plate fixed on the upper ends of the piston rods of said auxiliary cylinders over said drive cylinder, a pair of brackets respectively attached to two side ends connected to a conveyor belt driven by a motor, a projection attached to one of said brackets for serving as a reference point sensed by said plurality of third sensors, a pair of slide channels respectively attached beneath side ends of said carriage plate, and a pair of guide rails for guiding said slide channels.

7. The apparatus as defined in claim 6, wherein said third sensors are positioned alongside said guide rails so as to locate the positions of said grind felt device by detecting said projection, thereby grinding the portions of the surface of said screen panel in stepwise manner according to the positions of said grind felt device.

8. The apparatus as defined in claim 2, wherein said conveyor means comprises a pair of slide channels respectively attached beneath said jig pallet support plate at the two side corresponding to the positions of the pivot pin assemblies, a pair of guide rails mounted on a bottom plate of a mounting frame for slidably guiding said slide channels, a conveyor belt for horizontally moving said jig pallet support plate toward said discharge station by means of a motor through a drive pulley operatively connected with a driven pulley via a belt, said driven pulley being attached to a shaft with a conveyor pulley, and a connector attached to one side of said jig pallet support plate adjacent to one of the base parts for operatively connecting said jig pallet support plate with said conveyor belt.

9. The apparatus as defined in claim 8, wherein said wheel-shaped felt device comprises a wheel-shaped grind felt device for grinding the surface of said screen panel, and a shaft of a driven pulley for mounting said wheel-type grind felt device, said driven pulley being connected with a drive pulley of a motor by means of a belt, the rotational axis of said wheel-shaped grind felt device being parallel with the pivoting axis of said jig pallet.

10. The apparatus as defined in claim 9, wherein said wheel-shaped grind felt device comprises a pair of rubber disks mounted on the shaft of said driven pulley with a space between them and a ring-shaped felt for covering said space.

11. The apparatus as defined in claim 9, wherein said support and moving structure comprises a grinder support attached to a carriage plate by means of a drive cylinder with a piston rod, said drive cylinder being fixed on said carriage plate, a pair of auxiliary cylinders mounted at both sides of said drive cylinder on said carriage plate, a fixing plate fixed on the upper ends of the piston rods of said auxiliary cylinders over said drive cylinder, a pair of brackets respectively attached to two side ends connected to a conveyor belt driven by a motor, a projection attached to one of said brackets for serving as a reference point sensed by said plurality of third sensors, a pair of slide channels respectively attached beneath side ends of said carriage plate, and a pair of guide rails for guiding said slide channels.

12. The apparatus as defined in claim 11, wherein said third sensors are positioned alongside said guide rails so as to locate the positions of said grind felt device by detecting said projection, thereby grinding the portions of the surface of said screen panel in stepwise manner according to the positions of said grind felt device.

13. The apparatus as defined in claim 2, wherein said wheel-shaped felt device comprises a wheel-shaped grind felt device for grinding the surface of said screen panel, and a shaft of a driven pulley for mounting said wheel-shaped grind felt device, said driven pulley being connected with a drive pulley of a motor by means of a belt, the rotational axis of said wheel-shaped grind felt device being parallel with the pivoting axis of said jig pallet.

14. The apparatus as defined in claim 13, wherein said wheel-shaped grind felt device comprises a pair of rubber disks mounted on the shaft of said driven pulley with a space between them and a ring-shaped felt for covering said space.

15. The apparatus as defined in claim 13, wherein said support and moving structure comprises a grinder support attached to a carriage plate by means of a drive cylinder with a piston rod, said drive cylinder being fixed on said carriage plate, a pair of auxiliary cylinders mounted at both sides of said drive cylinder on said carriage plate, a fixing plate fixed on the upper ends of the piston rods of said auxiliary cylinders over said drive cylinder, a pair of brackets respectively attached to two side ends connected to a conveyor belt driven by a motor, a projection attached to one of said brackets for serving as a reference point sensed by said plurality of third sensors, a pair of slide channels respectively attached beneath side ends of said carriage plate, and a pair of guide rails for guiding said slide channels.

16. The apparatus as defined in claim 15, wherein said third sensors are positioned alongside said guide rails so as to locate the positions of said grind felt device by detecting said projection, thereby grinding the portions of the surface of said screen panel in stepwise manner according to the positions of said grind felt device.

17. The apparatus as defined in claim 1 wherein said wheel-shaped felt device comprises a wheel shaped grind felt device for grinding the surface of said screen panel, and a shaft of a driven pulley for mounting said wheel-shaped grind felt device, said driven pulley being connected with a drive pulley of a motor by means of a belt, the rotational axis of said wheel-shaped grind felt device being parallel with the pivoting axis of said jig pallet.

18. The apparatus as defined in claim 17, wherein said wheel-shaped grind felt device comprises a pair of rubber disks mounted on the shaft of said driven pulley with a space between them and a ring-shaped felt for covering said space.

19. The apparatus as defined in claim 17, wherein said support and moving structure comprises a grinder support attached to a carriage plate by means of a drive cylinder with a piston rod, said drive cylinder being fixed on said carriage plate, a pair of auxiliary cylinders mounted at both sides of said drive cylinder on said carriage plate, a fixing plate fixed on the upper ends of the piston rods of said auxiliary cylinders over said drive cylinder, a pair of brackets respectively attached to two side ends connected to a conveyor belt driven by a motor, a projection attached to one of said brackets for serving as a reference point sensed by said plurality of third sensors, a pair of slide channels respectively attached beneath side ends of said carriage plate, and a pair of guide rails for guiding said slide channels.

20. The apparatus as defined in claim 19, wherein said third sensors are positioned alongside said guide rails so as to locate the positions of said grind felt device by detecting said projection, thereby grinding the portions of the surface of said screen panel in stepwise manner according to the positions of said grind felt device.

* * * * *

UNITED STATES PATENT AND TRADEMARK OFFICE

CERTIFICATE OF CORRECTION

PATENT NO. : 5,679,054
DATED : October 21, 1997
INVENTOR(S) : Hong-Seok Chun; Yong-Tae Song; Hoon-Joon Yoo It is certified that error appears in the above-indentified patent and that said Letters Patent is hereby corrected as shown below:

Column 1, line 16, replace "scattered flown in the atmosphere" with -- scattered and thrown through the atmosphere -- .
Column 1, line 32, replace "flown in" with -- thrown through --.
Column 2, lines 24,26,28, change "illustrate" to -- illustrates -- (all occurrences).
Column 2, line 61, change "side" to -- sides --.
Column 3, line 61, change "is operated" to -- are operated --.
Column 4, line 18, after "finished" insert -- and --.
Column 5, line 40, change "side" to -- sides --.

Signed and Sealed this
Third Day of November, 1998

*Attest:*

*Attesting Officer*

Bruce Lehman

BRUCE LEHMAN

*Commissioner of Patents and Trademarks*